US005564898A

United States Patent [19]

Richards et al.

[11] Patent Number: 5,564,898

[45] Date of Patent: Oct. 15, 1996

[54] GAS TURBINE ENGINE AND A DIFFUSER THEREFOR

[75] Inventors: Stephen J. Richards, Coventry; Gabriel Simmonds, Birmingham; John E. Hatfield, Warwickshire, all of England

[73] Assignee: Rolls-Royce plc, London, England

[21] Appl. No.: 499,123

[22] Filed: Jul. 7, 1995

[30] Foreign Application Priority Data

Aug. 3, 1994 [GB] United Kingdom ..... 9415685

[51] Int. Cl.[6] ..... F01D 9/04

[52] U.S. Cl. ..... 415/211.2; 415/208.2; 415/226

[58] Field of Search ..... 415/208.2, 211.2, 415/226, 224.5

[56] References Cited

U.S. PATENT DOCUMENTS

| | | | |
|---|---|---|---|
| 3,552,877 | 1/1971 | Christ et al. | 415/211.2 |
| 4,013,378 | 3/1977 | Herzog | 415/208.2 |
| 4,182,595 | 1/1980 | Burney et al. | 415/211.2 |
| 4,344,737 | 8/1982 | Liu | 415/211.2 |
| 4,389,159 | 6/1983 | Sarvanne | 415/224.5 |
| 5,203,674 | 4/1993 | Vinciguerra | 415/211.2 |

FOREIGN PATENT DOCUMENTS

| | | | |
|---|---|---|---|
| 2925941 | 2/1980 | Germany | 415/211.2 |
| 57-126600 | 8/1982 | Japan | 415/224.5 |
| 1400761 | 7/1975 | United Kingdom . | |

*Primary Examiner*—Edward K. Look
*Assistant Examiner*—Michael S. Lee
*Attorney, Agent, or Firm*—Cushman Darby & Cushman, L.L.P.

[57] ABSTRACT

A gas turbine engine with first and second axial flow compressors and an intercooler therebetween is provided with a bend diffuser and a radial flow diffuser to diffuse the air leaving the downstream end of the first axial flow compressor at a first radial distance from the axis to the upstream end of the intercooler at a second radial distance from the axis. The bend diffuser comprises a first radially outer wall and a second radially inner wall. The first wall is elliptical and the second wall has a profile derived from a relationship between the local area ratio and the path length around the arc such there is rapid diffusion in the bend diffuser without fluid flow separation from the first wall.

19 Claims, 2 Drawing Sheets

GAS TURBINE ENGINE AND A DIFFUSER THEREFOR

The present invention relates to gas turbine engines, and in particular to gas turbine engines with axial flow compressors.

In gas turbine engines with axial flow compressors it is often necessary to transfer the fluid leaving the downstream end of one axial flow compressor at a first radial position to the upstream end of another axial flow compressor at a second radial position. The transfer of the fluid is usually achieved by locating a "swan necked" duct between the two axial flow compressors when there is sufficient axial space to do so. It is also often necessary to transfer the fluid leaving the downstream end of one axial flow compressor at a first radial position to an intercooler at a second radial position. The intercooler then supplies the cooled fluid to another axial flow compressor. The transfer of fluid from the first axial flow compressor to the intercooler is usually achieved by a "swan necked" duct.

However, where there is insufficient axial space to locate a "swan necked" duct the fluid must be transferred in some other way. If the fluid is transferred radially the pressure recovery in such a confined axial distance would very quickly overcome the momentum of the fluid flow and would produce excessive boundary layer growth and large areas of flow reversal.

Our UK patent application No. 9414018.3 filed on 12 Jul. 1994 discloses the use of a radial flow diffuser which has vanes to produce a plurality of radially extending passages in order to allow the air to be diffused in a relatively short axial length without excessive boundary layer growth and without flow reversals.

But the use of this radial flow diffuser requires a curved duct to transfer the fluid flow from an axial direction to a radial direction. The curved duct requires a relatively sharp fluid flow turning bend and this curved duct has a high possibility of fluid flow separation from the inner wall of the bend.

The present invention seeks to provide a curved duct for transferring fluid flow from an axial direction to a radial direction in which diffusion and sharp turning is achieved without fluid flow separation from the inner wall of the bend.

Accordingly the present invention provides a gas turbine engine having an axial flow compressor which has a downstream end at a first radial distance from the central axis of the gas turbine engine, at least one other component downstream of the axial flow compressor which has an upstream end at a second radial distance from the central axis, a bend diffuser positioned in flow series between the axial flow compressor and the at least one other component, the bend diffuser comprising a curved duct for turning the fluid flow leaving the axial flow compressor from an axial direction to a radial direction, the curved duct is annular and has a first wall and a second wall, the first wall has a small radius of curvature at its upstream end and the radius of curvature gradually increases in a downstream direction, the second wall has a profile derived from a relationship between the local area ratio and the path length around the arc such that there is rapid diffusion in the bend diffuser substantially without fluid flow separation from the first wall.

Preferably the first wall has an elliptical profile.

Preferably the second wall has a profile derived from the relationship path length is proportional to the (local area ratio $-1)^n$, where $^n$ is some power.

The second wall has an initial kink at its upstream end.

Preferably the radial diffuser is defined between a first radially extending wall and a second radially extending wall, a plurality of angularly spaced diffuser vanes are positioned between the first and second radially extending walls, the diffuser vanes extend generally radially to define a plurality of generally radially extending diffusing passages.

Preferably the diffuser vanes increase in cross-section from their radially inner ends to their radially outer ends.

Preferably the diffuser vanes are wedge shaped in cross-section.

Preferably the diffuser vanes increase in cross-section uniformly from their radially inner ends to their radially outer ends.

Preferably the first wall is the radially outer wall and the second wall is the radially inner wall, the curved duct turning the fluid flow from an axial direction to a radially outward direction.

The at least one component may comprise a second compressor and combustion means arranged in flow series.

The at least one component may comprise an intercooler, a second compressor and combustion means arranged in flow series.

Preferably the second compressor is an axial flow compressor.

The present invention also provides a bend diffuser comprising a curved duct for turning a fluid flow through substantially ninety degrees, the curved duct has a first wall and a second wall, the first wall has a small radius of curvature at a first end and the radius of curvature gradually increases towards the second end, the second wall has a profile derived from a relationship between the local area ratio and the path length around the arc such that there is rapid diffusion in the bend diffuser substantially without fluid flow separation from the first wall.

The first wall may have an elliptical profile.

The second wall may have a profile derived from the relationship path length is proportional to the (local area ratio $-1)^n$, where n is some power.

The curved duct may be annular.

The first wall may be the radially outer wall and the second wall is the radially inner wall, the curved duct turning the fluid flow from an axial direction to a radially outward direction.

The second wall has an initial kink at its upstream end.

The present invention will be more fully described by way of example, with reference to the accompanying drawings in which.

Figure 1:
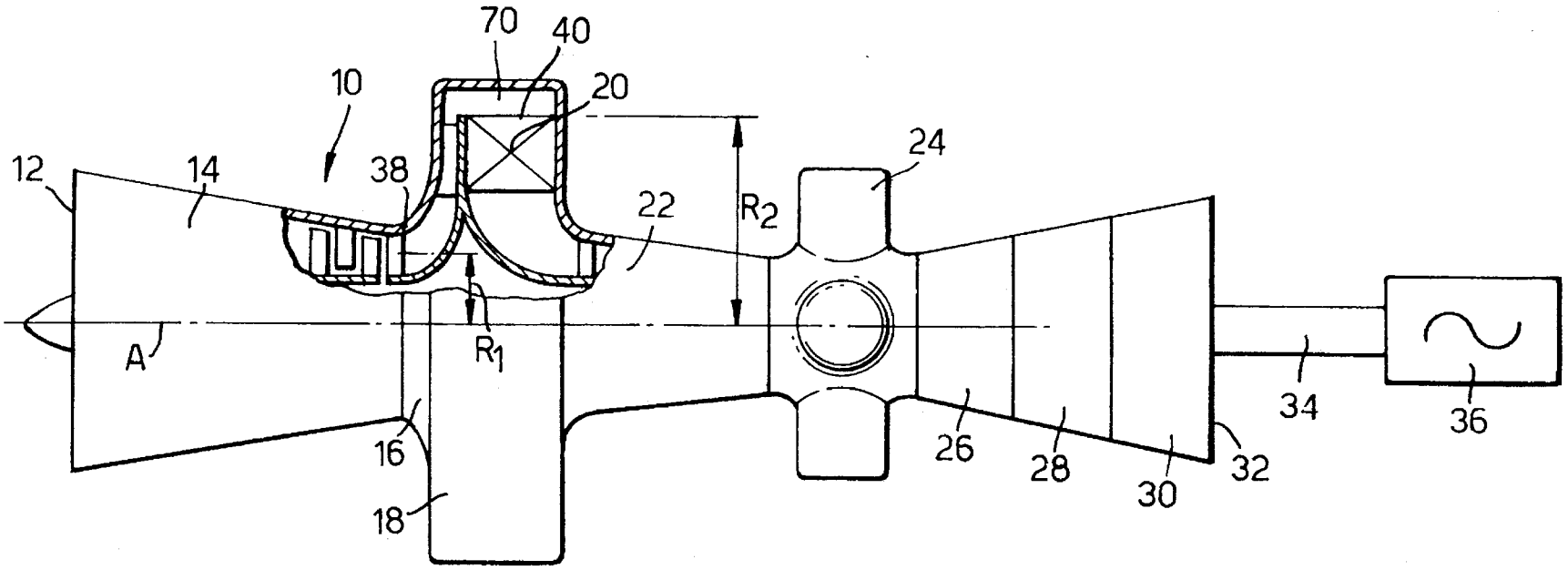
FIG. 1 is a partially cut away view of a gas turbine engine according to the present invention.

A gas turbine engine 10, shown in FIG. 1, comprises in flow series an inlet 12, a first axial flow compressor 14, a bend diffuser 16, a radial flow diffuser 18, an intercooler 20, a second axial flow compressor 22, a combustion system 24, a first turbine 26, a second turbine 28, a power turbine 30 and an exhaust 32. The first turbine 26 is arranged to drive the second axial flow compressor 22 via a shaft (not shown). The second turbine 28 is arranged to drive the first axial flow compressor 20 via a shaft (not shown). The power turbine 30 is arranged to drive an electrical generator 36 via a shaft 34. Alternatively the power turbine 30 may be arranged to drive a ships propeller, a pump or other device.

An intercooler 20 is provided in flow series between the first axial flow compressor 14 and the second axial flow compressor 22 so as to cool the air leaving the first axial flow compressor 14 before it enters the second axial flow compressor 22, so as to increase the efficiency of the gas turbine engine 10.

Figure 2:
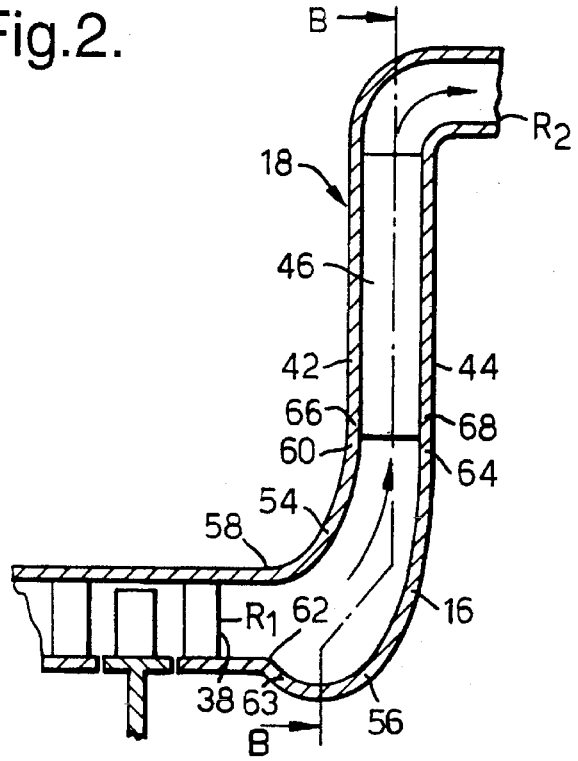
FIG. 2 is an enlarged cross-sectional view of the downstream end of the axial flow compressor and diffuser shown in FIG. 1.
Figure 3:
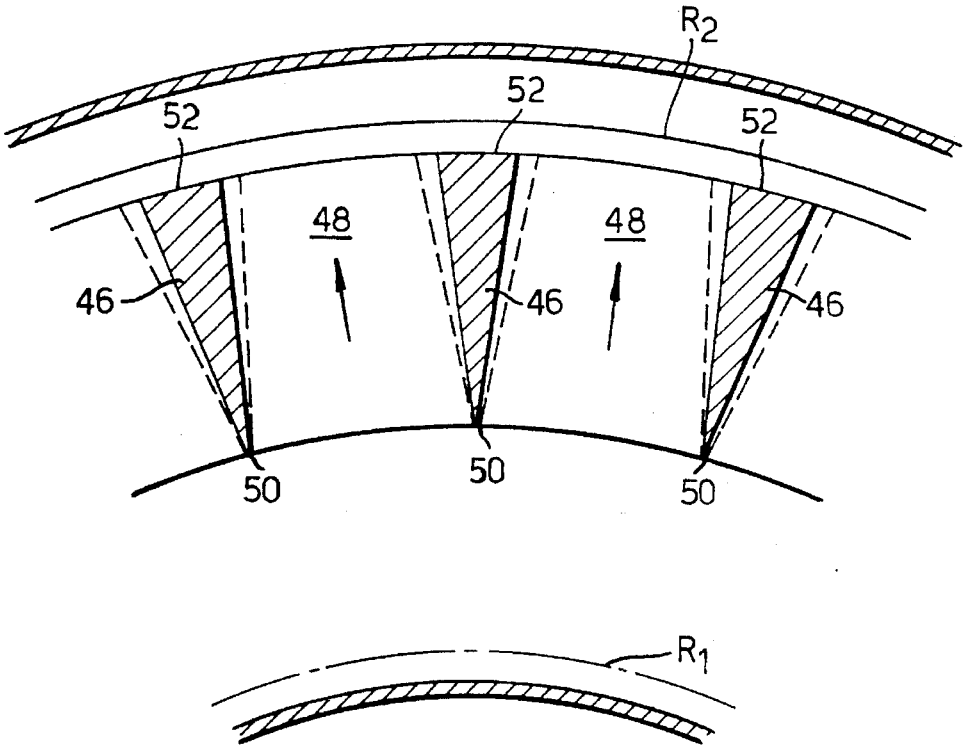
FIG. 3 is a view in the direction of arrows B in FIG. 2.

The downstream end 38 of the first axial flow compressor 14 is at a mean radial distance of $R_1$ from the central axis A of rotation of the gas turbine engine 10. The inlet 40 to the intercooler 20 is at a radial distance $R_2$ from the central axis A, and $R_2$ is greater than $R_1$. In order to transfer the fluid, air leaving the downstream end 38 of the first axial flow compressor 14 to the inlet 40 of the intercooler 20 the bend diffuser 16 and the radial flow diffuser 18 are provided as is shown more clearly in FIGS. 2 and 3.

The radial flow diffuser 18 is defined by a first, axially upstream radially extending wall 42 and a second, axially downstream, radially extending wall 44. The walls 42 and 44 are substantially parallel. A number of equi-angularly spaced vanes 46 are secured to and extend between the radially extending walls 42 and 44 and the vanes 46 define a number of radially extending diffusing passages 48. For example ten vanes 46 are provided to define ten passages 48. The vanes 46 are wedge shaped in cross-section and the narrow tips 50 of the vanes 46 are arranged at their radially innermost ends and the wide parts are arranged at their radially outermost ends. The diffusing passages 48 are two dimensional and the characteristics of the diffusing passages 48 are adjustable for various applications by using wedges of different angles as shown by the broken lines in FIG. 3. The wedges may increase uniformly with straight sides or non uniformly with curved sides from the ends 50 to the end 52. The passages 48 are rectangular in cross-section and the passages 48 have equal flow areas.

The radial flow diffuser 18 allows the air to be diffused in a relatively short axial length without excessive boundary layer growth and without flow reversals.

The bend diffuser 16 is annular and is defined by a first, radially outer, wall 54 and a second, radially inner, wall 56. The upstream end 58 of the first wall 54 is secured to the radially outer wall at the downstream end 38 of the first axial flow compressor 14. The downstream end 60 of the first wall 54 is secured to the radially inner end 66 of the first radially extending wall 42 of the radial flow diffuser 18. The first wall 54 is defined in such a way as to start with a small radius of curvature at its upstream end 58, i.e. rapid curvature, and the radius of curvature gradually increases in a downstream direction to its downstream end 60, i.e. reduction in curvature. The first wall 54 for example may have an elliptical profile to turn smoothly radially outwardly.

The upstream end 62 of the second wall 56 is secured to the radially inner wall at the downstream end 38 of the first axial flow compressor 14. The downstream end 64 of the second wall 56 is secured to the radially inner end 68 of the second radially extending wall 44 of the radial flow diffuser 18. The second wall 56 has a profile derived from a relationship between the local area ratio and the path length around the arc.

e.g.

$$L \alpha (AR-1)^n$$

where

L is the path length

AR is the local area ratio $^n$ is some power

This results in rapid diffusion and hence sharp deceleration and also produces a initial kink 63 at the upstream end 62 of the second wall 56. The kink 63 extends radially inwardly from the radially inner wall at the downstream end 38 of the first axial flow compressor 14. Thereafter the second wall 56 turns smoothly radially outwardly to join with the radially inner end 68 of the second radially extending wall 44 of the radial diffuser 18. A small amount of separation occurs immediately following the sharp deceleration on the second wall 56 but the fluid flow easily reattaches and more importantly it is believed that this fluid flow separation assists the boundary layer on the first wall 54 which remains attached around the bend diffuser 16. The sharp deceleration produces a substantially uniform velocity profile at the downstream end of the bend diffuser 16 and this makes it extremely tolerant to and facilitates further diffusion in the radial flow diffuser 18.

An axial chamber 70 is provided between the diffuser 18 and the intercooler 20 to provide the remaining diffusion of the air flow before it enters the intercooler 20.

The specific shape of the first wall 54 in one arrangement is elliptical with a major to minor access ratio of 2 to 1, and the relationship between the local area ratio and the path length around the arc of the second wall 56 is $$\frac{L}{\Delta R} = 4.7\,(AR-1)^{1.64}$$

where

L is the path length

AR is the local area ratio

ΔR is the passage height at the inlet to the bend diffuser.

The bend diffuser 16 turns the flow from an axial direction to a radial direction, it commences the diffusion process which is completed by the radial diffuser, it minimizes total pressure loss and it provides an acceptable flow profile at the exit, i.e., it ensures that the fluid flow remains attached to the walls around the bend. Additionally the Coanda effect is employed to ensure the flow remains attached to the first wall. This enables high levels of diffusion to be achieved in a minimum axial space as possible with minimum total pressure loss.

Also there is a cross-sectional area increase from the upstream end to the downstream end of the bend diffuser.

The use of the bend diffuser reduces, or overcomes, the above mentioned problems.

Although the invention has been described with reference to an annular diffuser in which the fluid flow is turned radially outwardly from an axial direction, it is clearly possible to arrange an annular diffuser in which the fluid flow is turned radially inwardly from an axial direction. The invention may also be used to supply fluid through other types of 90° bends and also the diffuser need not be restricted to an annular diffuser.

We claim:

1. A gas turbine engine including an axial flow compressor and at least one other component downstream of the axial flow compressor, the gas turbine engine having a central axis, the axial flow compressor has a downstream end at a first radial distance from the central axis of the gas turbine engine, the at least one other component has an upstream end at a second radial distance from the central axis of the gas turbine engine, a bend diffuser is positioned in flow series between the downstream end of the axial flow compressor and the upstream end of the at least one other component, the bend diffuser comprises a curved duct for turning the fluid flow leaving the downstream end of the axial flow compressor from an axial direction to a radial direction, the curved duct is annular and is defined by a first wall and a second wall, the first wall has an upstream end and a downstream end, the first wall has a small radius of curvature at its upstream end and the radius of curvature gradually increases in a downstream direction, the second wall has a profile derived from a relationship between the local area ratio and the path length around the arc such that there is a rapid diffusion in the bend diffuser substantially without fluid flow separation from the first wall.

2. A gas turbine engine as claimed in claim 1 in which the first wall has an elliptical profile.

3. A gas turbine engine as claimed in claim 1 in which the second wall has a profile derived from the relationship path length is proportional to the (local area ratio $-1)^n$, where $^n$ is some power.

4. A gas turbine engine as claimed in claim 3 in which the relationship is $$\frac{L}{\Delta R} = 4.7\,(AR-1)^{1.64}$$

where L is the path length, AR is the local area ratio and ΔR is the duct height at the inlet to the bend diffuser.

5. A gas turbine engine as claimed in claim 1 in which a radial diffuser is positioned in flow series between the bend diffuser and the upstream end of the at least one other component, the radial diffuser is defined between a first radially extending wall and a second radially extending wall, a plurality of angularly spaced diffuser vanes are positioned between the first radially extending wall and the second radially extending wall, the diffuser vanes extend generally radially to define a plurality of generally radially extending diffusing passages.

6. A gas turbine engine as claimed in claim 5 in which the diffuser vanes increase in cross-section from their radially inner ends to their radially outer ends.

7. A gas turbine engine as claimed in claim 6 in which the diffuser vanes are wedge shaped in cross-section.

8. A gas turbine engine as claimed in claim 6 in which the diffuser vanes increase in cross-section uniformly from their radially inner ends to their radially outer ends.

9. A gas turbine engine as claimed in claim 1 in which the first wall is the radially outer wall and the second wall is the radially inner wall, the curved duct turning the fluid flow from an axial direction to a radially outward direction.

10. A gas turbine engine as claimed in claim 1 in which the at least one component comprises a second compressor and combustion means arranged in flow series.

11. A gas turbine engine as claimed in claim 1 in which the at least one component comprises an intercooler, a second compressor and combustion means arranged in flow series.

12. A gas turbine engine as claimed in claim 10 or claim 11 in which the second compressor is an axial flow compressor.

13. A gas turbine as claimed in claim 1 in which the second radial distance is greater than the first radial distance.

14. A bend diffuser comprising a curved duct for turning a fluid flow through substantially ninety degrees, the curved duct has a first wall and a second wall, the first wall has a first end and a second end, the first wall has a small radius of curvature at the first end and the radius of curvature gradually increases towards the second end of the first wall, the second wall has a first end and a second end, the second wall has a profile derived from a relationship between the local area ratio and the path length around the arc such that there is rapid diffusion in the bend diffuser substantially without fluid flow separation from the first wall.

15. A bend diffuser as claimed in claim 14 in which the first wall has an elliptical profile.

16. A bend diffuser as claimed in claim 14 in which the second wall has a profile derived from the relationship path length is proportional to the (local area ratio $-1)^n$, where $^n$ is some power.

17. A bend diffuser as claimed in claim 16 in which the relationship is $$\frac{L}{\Delta R} = 4.7\,(AR-1)^{1.64}$$

where L i the path length, AR is the local area ratio and ΔR is the duct height at the inlet to bend diffuser.

18. A bend diffuser as claimed in claim 14 in which the curved duct is annular.

19. A bend diffuser as claimed in claim 18 in which the first wall is the radially outer wall and the second wall is the radially inner wall, the curved duct turning the fluid flow from an axial direction to a radially outward direction.

* * * * *